US010206436B1

(12) United States Patent
Wooley-Scheiman

(10) Patent No.: US 10,206,436 B1
(45) Date of Patent: Feb. 19, 2019

(54) ATHLETIC SUPPORT SYSTEM

(71) Applicant: Jennifer Wooley-Scheiman, St. Augustine, FL (US)

(72) Inventor: Jennifer Wooley-Scheiman, St. Augustine, FL (US)

( * ) Notice: Subject to any disclaimer, the term of this patent is extended or adjusted under 35 U.S.C. 154(b) by 0 days.

(21) Appl. No.: 15/834,850

(22) Filed: Dec. 7, 2017

(51) Int. Cl.
*A41C 3/00* (2006.01)

(52) U.S. Cl.
CPC ..... *A41C 3/0057* (2013.01)

(58) Field of Classification Search
CPC ..... A41C 3/0057; A41C 3/00
USPC ..... 450/86, 1
See application file for complete search history.

(56) References Cited

U.S. PATENT DOCUMENTS

| | | | | |
|---|---|---|---|---|
| 724,817 | A | 4/1903 | Covert | |
| 4,816,005 | A | 3/1989 | Braaten | |
| 6,165,045 | A | 12/2000 | Miller et al. | |
| 6,168,498 | B1 | 1/2001 | Wagner | |
| 8,460,054 | B2 | 6/2013 | Swendseid | |
| 8,900,032 | B2 | 12/2014 | Punsal | |
| 2012/0040558 | A1 | 2/2012 | Steel et al. | |
| 2013/0054777 | A1* | 2/2013 | Aguiar | H04L 41/044 709/224 |

* cited by examiner

*Primary Examiner* — Gloria Hale

(57) ABSTRACT

An athletic support system for supporting breasts during athletic activities includes a sports bra that may be worn on a woman's chest. The sports bra has a pair of cups, a cup frame and a pair of shoulder straps. Each of the shoulder straps joins together between each of the cups to define a cleavage portion of the sports bra. The cleavage portion extends across the woman's cleavage thereby inhibiting the woman's breasts from falling out of the cups during athletic activities.

4 Claims, 3 Drawing Sheets

ATHLETIC SUPPORT SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to support devices and more particularly pertains to a new support device for supporting breasts during athletic activities.

BRIEF SUMMARY OF THE INVENTION

An embodiment of the disclosure meets the needs presented above by generally comprising a sports bra that may be worn on a woman's chest. The sports bra has a pair of cups, a cup frame and a pair of shoulder straps. Each of the shoulder straps joins together between each of the cups to define a cleavage portion of the sports bra. The cleavage portion extends across the woman's cleavage thereby inhibiting the woman's breasts from falling out of the cups during athletic activities.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
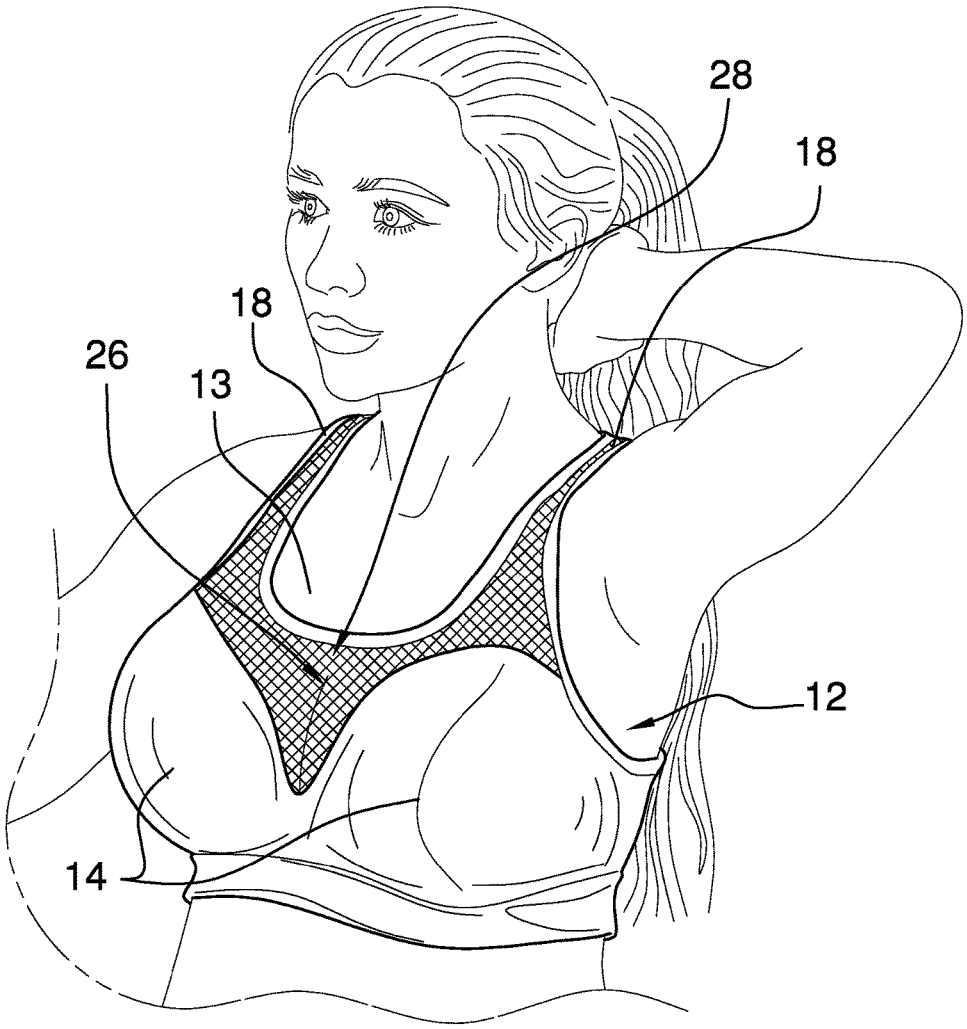
FIG. 1 is a perspective in-use view of an athletic support system according to an embodiment of the disclosure.
Figure 2:
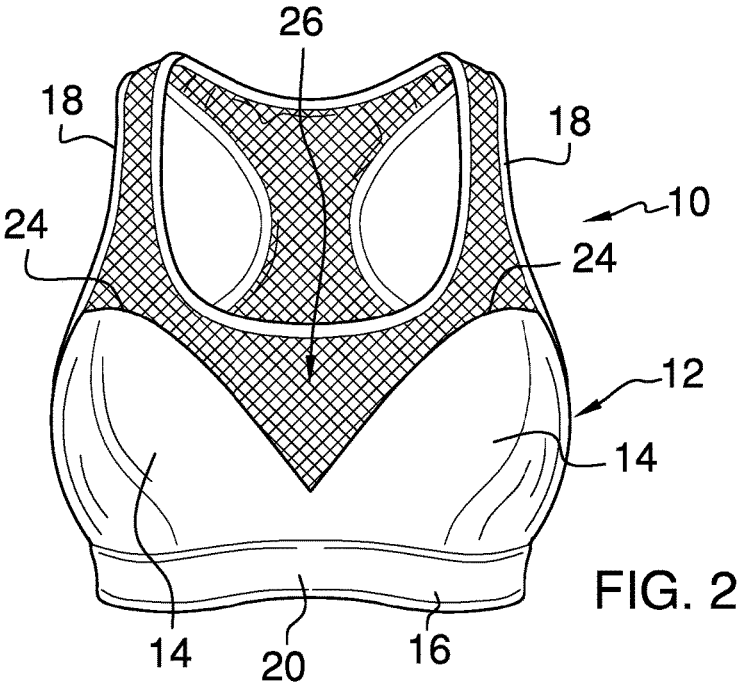
FIG. 2 is a front view of an embodiment of the disclosure.
Figure 3:
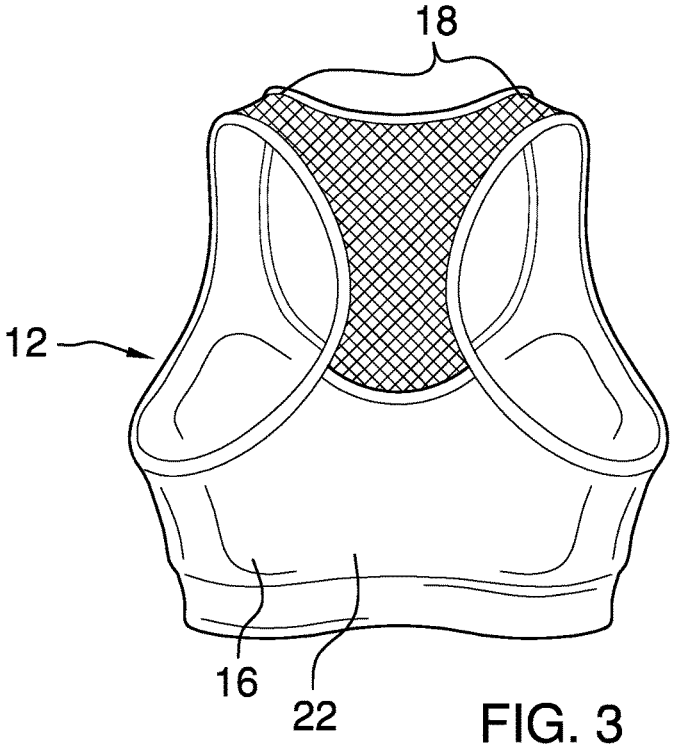
FIG. 3 is a back view of an embodiment of the disclosure.

With reference now to the drawings, and in particular to FIGS. 1 through 4 thereof, a new support device embodying the principles and concepts of an embodiment of the disclosure and generally designated by the reference numeral 10 will be described.

Figure 4:
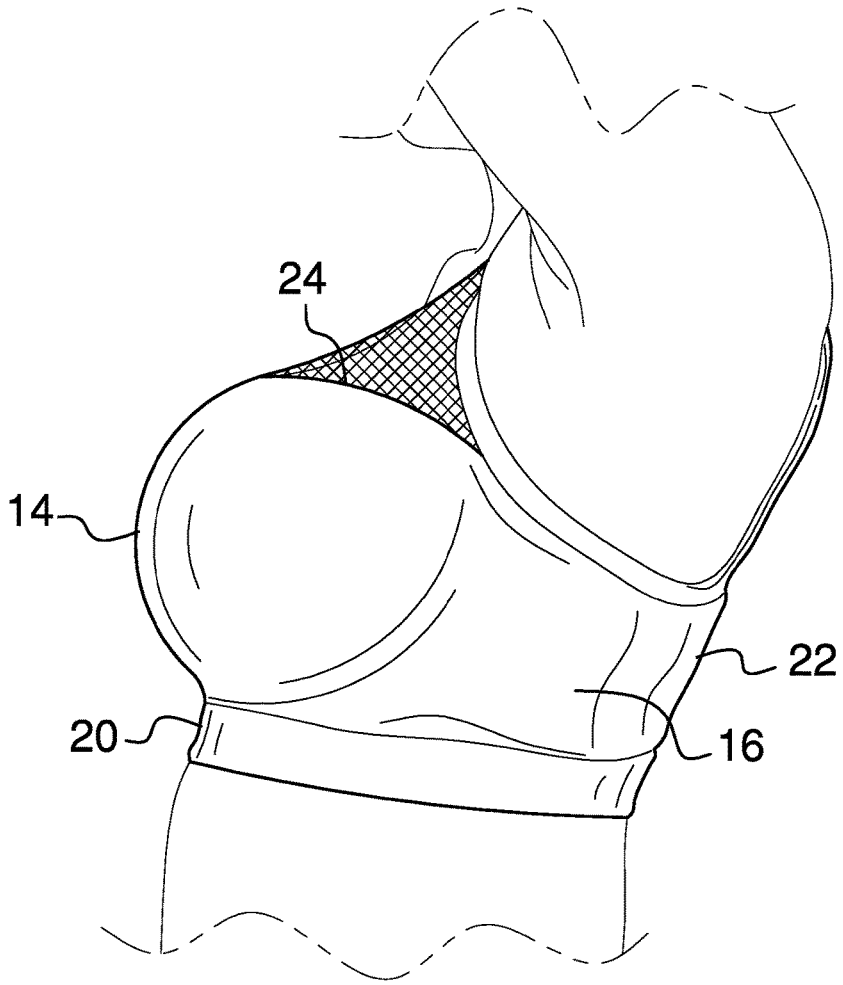
FIG. 4 is a left side in-use view of an embodiment of the disclosure.

As best illustrated in FIGS. 1 through 4, the athletic support system 10 generally comprises a sports bra 12 that is selectively worn on a woman's chest 13. The sports bra 12 has a pair of cups 14, a cup frame 16 and a pair of shoulder straps 18. The cup frame 16 is continuous such that the cup frame 16 forms a closed loop to extend around the woman's torso 19. The cup frame 16 has a front side 20 and back side 22. Each of the cups 14 is positioned on the front side 20 of the cup frame 16 and each of the cups 14 has an upper edge 24. As shown in FIG. 4, the cup frame 16 has a height that is sufficient to completely cover the woman's side cleavage when the sports bra 12 is worn.

Each of the shoulder straps 18 is comprised of a mesh material to pass air therethrough. Thus, the shoulder straps 18 allow body heat to pass therethrough during exercise to enhance the woman's comfort. Each of the shoulder straps 18 joins together between each of the cups 14 to define a cleavage portion 26 of the sports bra 12. The cleavage portion 26 extends across the woman's cleavage 28 thereby inhibiting the woman's breasts from falling out of the cups 14 during athletic activities. In this way the cleavage portion 26 enhances the woman's feelings of security and comfort during athletic activities.

Each of the shoulder straps 18 extends between the upper edge 24 corresponding to an associated one of the cups 14 and the back side 22 of the cup frame 16. The cleavage portion 26 extends upwardly from the upper edge 24 of each of the cups 14 and extends between each of the cups 14. In this way the cleavage portion 26 inhibits the woman's breasts from passing over the upper edge 24 of the cups 14. The sports bra 12 may be manufactured according to standard bra sizes with respect to cup size and cup frame 16 diameter.

In use, the sports bra 12 is worn during athletic activities. The cleavage portion 26 extends between each of the cups 14 to completely cover the woman's cleavage 28. In this way the cleavage portion 26 inhibits the woman's breasts from passing over the upper edge 24 of each of the cups 14. Thus, the cleavage portion 26 enhances the woman's self esteem and sense of security during athletic activity. The mesh construction of the shoulder straps 18 allows body heat to pass through the shoulder straps 18 to assist the woman to stay cool during the athletic activity.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An athletic support system being configured to be worn by a woman during athletic activities, said system comprising:

a sports bra being configured to be worn on a woman's chest, said sports bra having a pair of cups, a cup frame and a pair of shoulder straps, each of said shoulder straps being comprised of a mesh material wherein each of said shoulder straps is configured to pass air therethrough, each of said shoulder straps joining together between each of said cups to define a cleavage portion of said sports bra extending downwardly between said pair of cups past a vertical midpoint of each of said cups wherein said cleavage portion is configured to extend along and across the woman's cleavage thereby positioning said mesh material over the woman's cleavage while inhibiting the woman's breasts from falling out of said cups during athletic activities.

2. The system according to claim 1, wherein said cup frame is continuous such that said cup frame forms a closed loop wherein said cup frame is configured to extend around a woman's torso, said cup frame having a front side and back side, each of said cups being positioned on said front side of said cup frame, each of said cups having an upper edge.

3. The system according to claim 2, wherein each of said shoulder straps extends between said upper edge corresponding to an associated one of said cups and said back side of said cup frame, said cleavage portion extending upwardly from said upper edge of each of said cups and extending between each of said cups.

4. An athletic support system being configured to be worn by a woman during athletic activities, said system comprising:

a sports bra being configured to be worn on a woman's chest, said sports bra having a pair of cups, a cup frame and a pair of shoulder straps, said cup frame being continuous such that said cup frame forms a closed loop wherein said cup frame is configured to extend around a woman's torso, said cup frame having a front side and back side, each of said cups being positioned on said front side of said cup frame, each of said cups having an upper edge, each of said shoulder straps being comprised of a mesh material wherein each of said shoulder straps is configured to pass air therethrough, each of said shoulder straps joining together between each of said cups to define a cleavage portion of said sports bra extending downwardly between said pair of cups past a vertical midpoint of each of said cups wherein said cleavage portion is configured to extend along and across the woman's cleavage thereby positioning said mesh material over the woman's cleavage while inhibiting the woman's breasts from falling out of said cups during athletic activities, each of said shoulder straps extending between said upper edge corresponding to an associated one of said cups and said back side of said cup frame, said cleavage portion extending upwardly from said upper edge of each of said cups and extending between each of said cups.

* * * * *